US007000765B2

(12) United States Patent
Hase et al.

(10) Patent No.: US 7,000,765 B2
(45) **Date of Patent: *Feb. 21, 2006**

(54) CONTAINER COMPRISING AN ELECTRICALLY DRIVEN INTERLOCKING MECHANISM

(75) Inventors: Stephan Hase, Sinntal (DE); Götz Cönen, Meerbusch (DE)

(73) Assignee: Lepus Vermögensverwaltung GmbH, (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/505,609

(22) PCT Filed: Feb. 20, 2002

(86) PCT No.: PCT/DE02/00623

§ 371 (c)(1),
(2), (4) Date: Aug. 20, 2004

(87) PCT Pub. No.: WO03/070604

PCT Pub. Date: Aug. 28, 2003

(65) Prior Publication Data

US 2005/0103647 A1 May 19, 2005

(51) Int. Cl.
*B66C 1/66* (2006.01)

(52) U.S. Cl. ..... 206/503; 220/1.5; 220/23.4; 220/23.6; 24/287

(58) Field of Classification Search ..... 206/503, 206/504, 509; 24/287; 220/1.5, 4.27, 23.4, 220/23.6, 23.83; 294/68.1, 68.3, 81.53; 340/686.1, 340/686.2, 686.3; 280/8, 9; 410/78, 80
See application file for complete search history.

(56) References Cited

U.S. PATENT DOCUMENTS

| | | | | |
|---|---|---|---|---|
| 3,368,838 A | | 2/1968 | Reich | |
| 3,691,595 A | * | 9/1972 | Backteman et al. | 24/287 |
| 3,872,555 A | | 3/1975 | Link et al. | |
| 3,980,185 A | * | 9/1976 | Cain | 206/509 |
| 4,626,155 A | * | 12/1986 | Hlinsky et al. | 410/82 |
| 2004/0124647 A1 | * | 7/2004 | Hase et al. | 294/81.53 |

FOREIGN PATENT DOCUMENTS

| | | |
|---|---|---|
| DE | 26 17 582 | 11/1977 |
| DE | 26 30 012 | 1/1978 |
| DE | 43 28 635 | 9/1994 |
| DE | 196 03 998 | 8/1997 |
| GB | 2 173 540 | 10/1986 |

* cited by examiner

*Primary Examiner*—Mickey Yu
*Assistant Examiner*—Jerrold Johnson
(74) *Attorney, Agent, or Firm*—Robert W Becker & Associates; Robert W Becker

(57) ABSTRACT

A container having corner regions with hollow bodies is provided. Locking devices are provided that are received in the corner regions. Electrically driven, rotatable and displaceable locking mechanisms are respectively disposed in corners of the container. For a lower region of each locking mechanism, a locking member is provided that is adapted to engage in corresponding hollow bodies, disposed on upper corner regions of a comparable container disposed there below and adapted to receive locking devices, for interlocking the containers, sensors and signal emitters are disposed in the container for indicating a respective position of one of the locking mechanisms in a corner of the container.

11 Claims, 4 Drawing Sheets

CONTAINER COMPRISING AN ELECTRICALLY DRIVEN INTERLOCKING MECHANISM

BACKGROUND OF THE INVENTION

The invention relates to containers with electrically driven locking mechanisms, and in particular to shipping containers. It is, however, applicable to all containers in the same manner, irrespective of size and shape, on the outer walls of which hollow bodies are provided for the accommodation of locking devices. The invention is explained hereinafter in greater detail by way of the example of a shipping container.

The transport of freight goods is effected nowadays worldwide preponderantly by the use of standardized containers. The containers are deposited at the loading location, loaded there, and then loaded onto a vehicle (road or rail vehicle), if appropriate conveyed to a harbor or airport, there loaded onto a ship or aircraft, and therefore interlocked and lashed together with other containers in order to provide secure transport, unlocked and released from lashings again at the place of arrival, and loaded onto a vehicle, brought to the destination location, and offloaded there. containers which is both safe and rapid, whereby the technology being applied must be capable of accommodating, transporting, or interlocking containers of different dimensions. Containers exhibit in their upper and lower corner areas in each case hollow bodies (referred to as "corner castings"), which are provided with oval openings on their sides which face outwards. Locking devices from depositing equipment (container spreaders) or overhead handling equipment can be introduced into these oval openings, whereby these locking devices exhibit end areas (twistlocks) of which the dimensions are smaller than the oval openings in the corner castings. As soon as the twistlocks have been introduced into the corner castings, they are mechanically rotated, so that the container is locked to the container spreader or the overhead handling equipment and can be transported. When raising, the upper side of the twistlock comes into contact with the underside of the cover wall of the hollow body.

Container spreaders are known which can simultaneously accommodate and move two 20' containers standing one behind the other (there are standardized 20' containers, 40' containers, and 45' containers).

The advantage of such container spreaders is limited, however, since on the one hand only the small containers (20 feet) can be accommodated, while on the other hand two such containers must stand one behind the other and the possibility of use only pertains in situations in which there is sufficient deposition space. The situation becomes particularly problematic if several containers stacked on top of one another must be interlocked, such as is necessary in particular with ships' loads or in container terminals. In this case, interlocking takes place manually, in that two containers arranged on top of one another or next to one another are locked to one another by means of connection and locking elements (locking grips or bars). This is time-consuming and, because of the risk of injury when applying the connecting and locking elements, also dangerous.

The object of the present invention is to provide a container which is equipped in such a way that it can be interlocked with other containers of the same type without manual intervention, and several containers stacked on top of one another can be transported simultaneously.

SUMMARY OF THE INVENTION

This object is realized by a container having corner regions with hollow bodies, the container further comprising locking devices that are adapted to be received in the corner regions; corners; electrically driven, rotatable and displaceable mechanisms respectively disposed in the corners; for a lower region of each locking mechanism, a locking member that is adapted to engage in corresponding hollow bodies, disposed on upper corner regions of a comparable container disposed there below and adapted to receive locking devices, for interlocking the containers; and sensors and signal emitters for indicating a respective position of one of the locking mechanisms in a corner of the container.

The corners of the container exhibit electrically driven, rotatable, and displaceable locking mechanisms. If it is intended that two containers should be stacked on top of or beneath one another, the one container is placed on the other container in such a way that the lower corner castings of the upper container are flush with the upper corner castings of the lower container. Because the locking mechanisms in the corners of the upper container are displaceable, they can be pressed downwards by the electric drive and engage in the upper corner castings of the lower container. In this state, a rotation of the locking mechanisms can take place, so that the containers can be locked to one another and, if required, raised and transported simultaneously. With the invention it is possible, without manual intervention, to carry out a continuous vertical interlocking of as many containers as may be desired above or beneath one another. As a result, during the loading or unloading of ships, several containers stacked above one another can be lifted and moved simultaneously, with the result that loading and unloading time is substantially reduced. As a result of this, not only will berthage charges in ports be reduced, but demurrage times will be substantially shortened and available voyage times of vessels increased, as a result of which faster transport of the containers from port to port will become possible. The profitability of the vessel will at the same time be optimized.

A further substantial advantage of the invention lies in the fact that the manual locking and lashing which was customary hitherto can be done away with, and therefore the risk of injury of the workers in the port or on the vessel can be minimized. Additional substantial costs savings will be obtained as a result.

According to a preferred embodiment, the container exhibits a frame structure design, of which at least one frame part has at least one water-tight closable opening. The purpose of this opening is that the locking mechanism secured in the corner which is designed as a hollow body, which according to a further preferred embodiment is designed as a module, can be taken out of the corner and reinserted. In this way, defective parts can be immediately replaced and long repair times avoided. The container will constantly be kept ready for use.

If, according to a further embodiment, the hollow bodies are connected to their adjacent frame parts in a releasable manner, openings in the frame parts can be used to connect the frame parts to the adjacent hollow bodies from the inside. Inasmuch as parts of the device according to the invention are located in the frame parts, access to these parts is guaranteed, so that both construction as well as maintenance are possible without any problem.

According to a further advantageous embodiment, the container exhibits means of accepting and forwarding electrical energy. In this way, the supply of electric current to the container can be guaranteed. This is particularly necessary for the operation of the locking device and the control unit.

This control unit controls the introduction of electricity into the locking mechanism and the onward conveyance of electricity to a discharge location in the area of the lower hollow body, by means of which electricity can be passed on into the next lower container. In addition, the control unit accepts the signals which, according to a further preferred embodiment, are transmitted to it by the signal generator, which is in contact with sensors. The intention of these signals is to indicate to the crane driver the position in which the locking mechanism is located. Moreover, according to a preferred embodiment data like the year of construction, the service interval or the load of the container as well as its places of departure and arrival or its location are stored in the control unit and may be recalled on demand.

To advantage, the electrically driven locking mechanism comprises a cylinder, in the wall of which a longitudinal cut-out is located, which has approximately the appearance of a V rotated through 90°. A bolt engages into this cut-out, which is secured to the locking bar. This link drive arrangement allows for a rotation of the locking mechanism, and therefore the locking of the containers to one another.

It is likewise of advantage if the cylinder has an engagement nose on its lower end, which can engage in engagement grooves which are located on the locking bar. As a result of this, the cylinder can control the upwards and downwards movement of the locking bar section by section.

BRIEF DESCRIPTION OF THE DRAWINGS

The invention is described hereinafter in greater detail on the basis of FIGS. 1 to 4.

The Figures show.

DESCRIPTION OF SPECIFIC EMBODIMENTS

Figure 1:
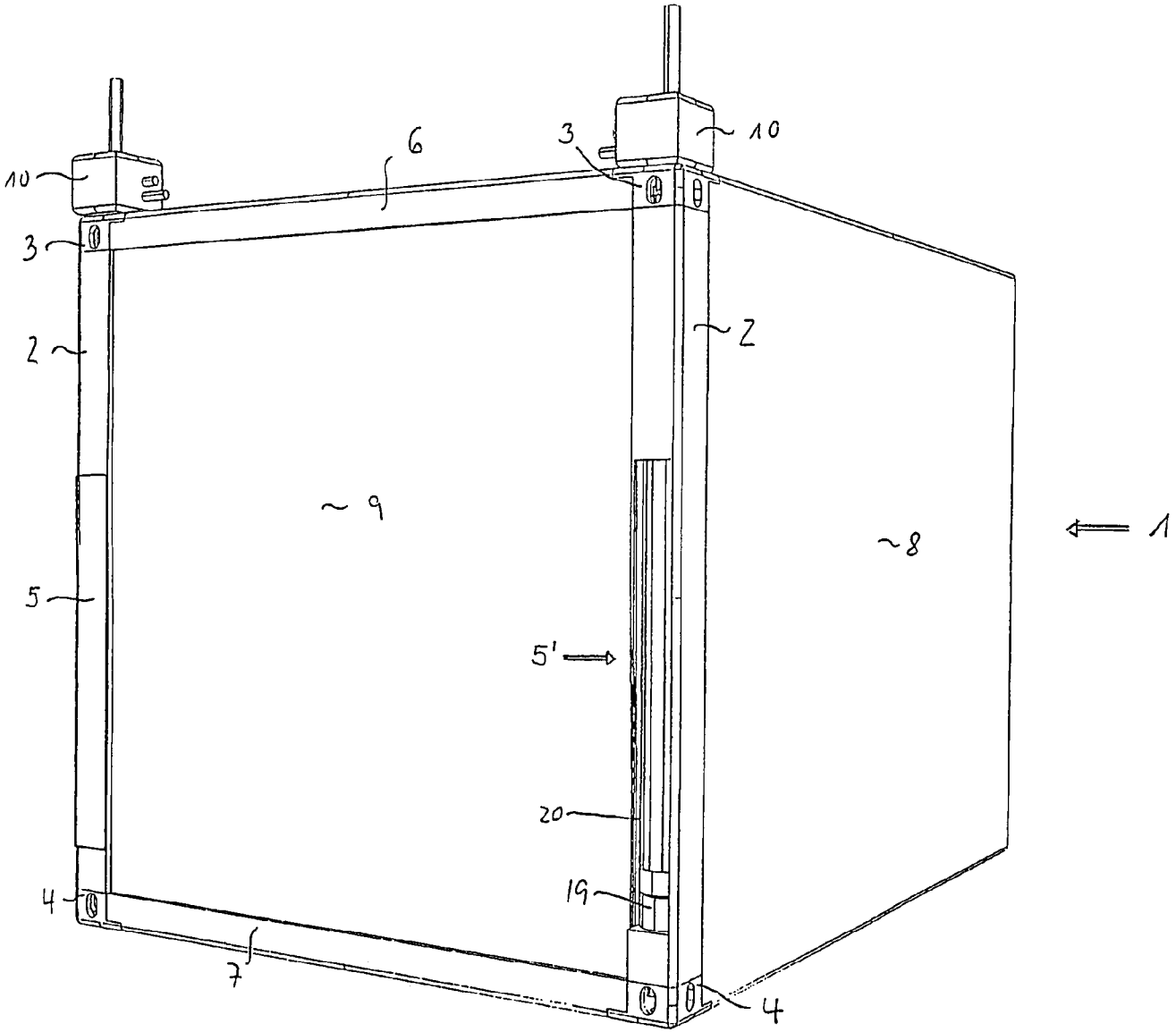
FIG. 1: A part view of a container, which is locked to a container spreader with an opened corner.

FIG. 1 represents a container (1) in a part view. It exhibits corners (2), on the upper end of which is located a locking housing (3), referred to hereinafter as a casting, and on the lower end of which a casting (4) is located. The container corners (2) are hollow on the inside and exhibit closure elements (5) at their lower area. This closure element is represented, for the purposes of the representation, as lying on the outside of the container corner. Expediently, the closure element is, however, located on the inside of the container and is guided over the corner, so that good accessibility is provided into the interior of the container corner. Thanks to this positioning, the interior of the container corner is protected against dirt and water. The closure element is bolted to the corner of the container by means of a water-tight and dust-tight seal, not represented here in any greater detail.

The upper castings are connected to one another by means of upper transverse frames (6), and the lower castings to one another by means of lower transverse frames (7). Upper and lower transverse frames can also be located on the longitudinal side of the container, which are not represented here in any greater detail.

Further identifiable in FIG. 1 are side walls (8,9). Here also, two carrier arms (10) are represented, of a container spreader not otherwise represented in any greater detail. Located on the lower ends of the carrier arms, likewise not represented, are twistlocks, with which the container spreader is locked to the containers.

FIG. 1 further exhibits a container corner (2) with opened closure element area (5'). A cylindrical housing can be seen which is partly located in a housing (20).

Figure 2:
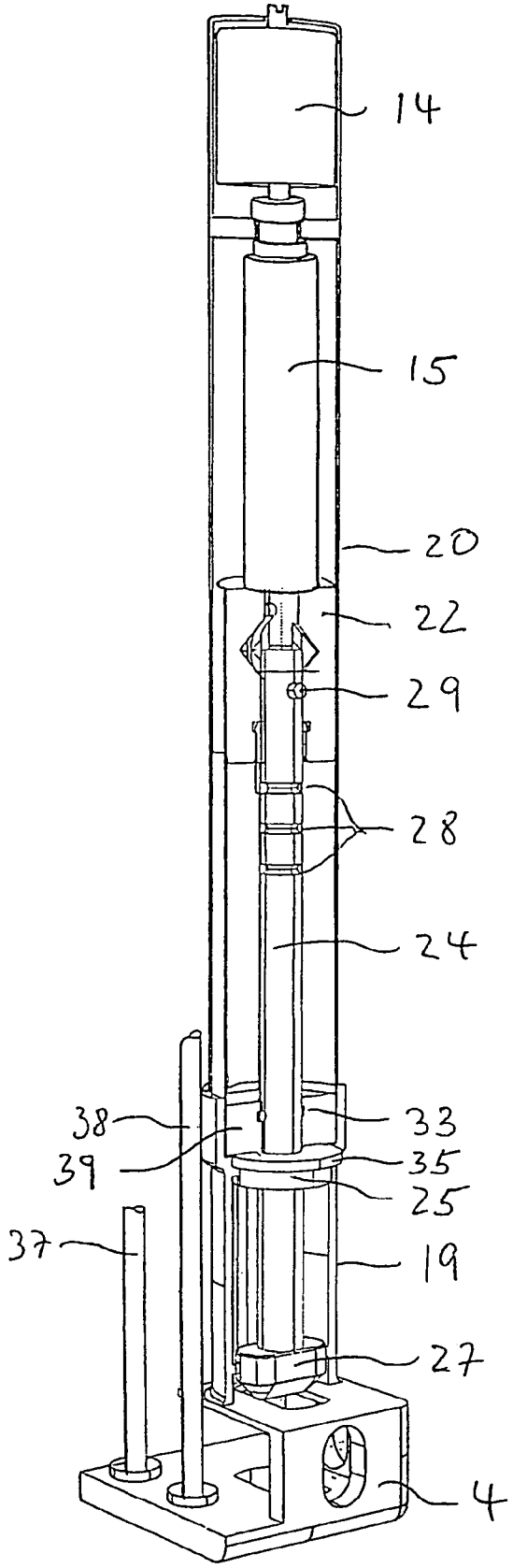
FIG. 2: The technical equipment of a container corner.

FIG. 2 shows the technical equipment of a container corner. An electric drive (14) is located in the housing (20). An inner threaded rod (16) which is driven by the drive (14,) and an outer threaded rod (17), which is tightly fixed to the piston (22), are positioned in the housing (15). The piston (22) is axially displacable but not rotatably borne in the housing (20) and is guided by the inner wall of the housing (20). The locking bar (24), which includes three engagement grooves (28), is displacebly borne in the piston (22). Tightly connected to the locking bar is a bolt (29) which projects through an opening in the piston housing which has roughly the shape of a V rotated through 90°. The assembly of this opening and the bolt (29) establish a link drive arrangement (23). At the lower end of the housing (20) a guide (39) is located which guides the locking bar (24). A seal (33) prevents the penetration of water or dirt from the housing (19) into the inside of the housing (20).

Tightly connected to the locking bar (24) is a support bearing (25) at the upper end of which a securing part (35) with a guiding groove (34) is arranged.

A locking element (twistlock 27) represents the lower end of the locking bar. The casting (4) represents the lower end of the housing (19).

Wires (37, 38) lead into the bottom of the container in the area of the casting (4).

The functional method of the locking mechanism will be explained with respect to FIGS. 3*a* and *b* as well as 4*a* and *b*.

When the casting (4) of the upper container comes in contact onto the casting (3) of the container located beneath, a signal pin, not represented in any greater detail, is pressed into the interior of the casting (4) and transfers a signal via one of the wires (37, 38) to the crane driver that the locking process may be initiated.

Figure 3:
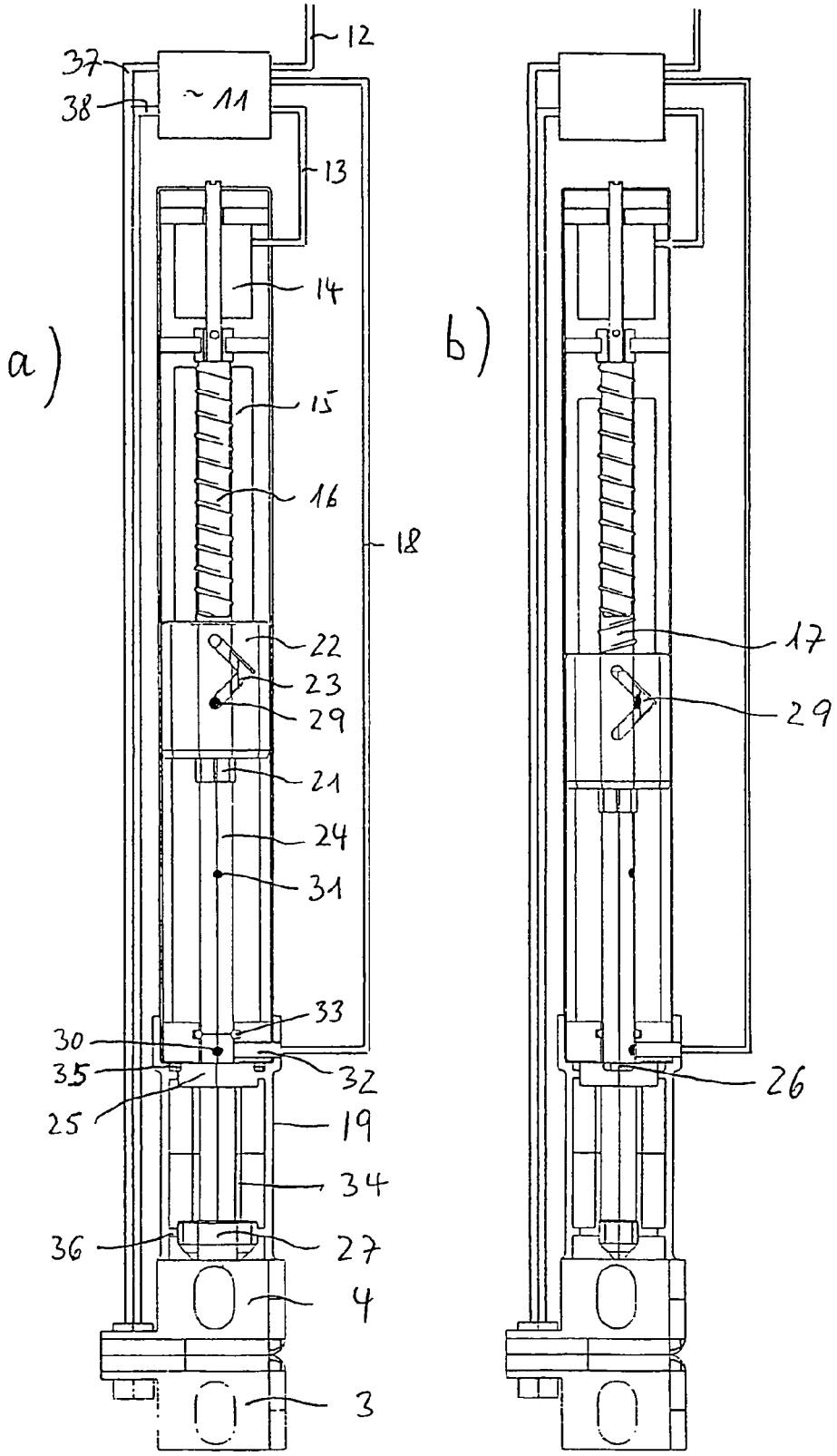
FIGS. 3*a* and 3*b* and 4*a* and 4*b*: The movement sequence during the interlocking of a container with another container.

In FIG. 3*a* the twistlock (27) is positioned transversely to the upper opening of the casting (4) so that the locking bar is prevented from being led downwards. Electrical energy is led via the wire (12) to a control unit (11). If the locking process is to be initiated the crane driver gives a signal via the wire (12) to the control unit (11) which then directs electrical energy via the wire (13) to the electric drive (14). The drive (14) drives the threaded rod (16) which meshes with the threaded rod (17) and moves it upwards or downwards dependent on the rotation direction. When the threaded rod (17) is moved downwards the piston (22) is pushed downwards. As indeed the locking bar (24) cannot move downwards because this is prevented by the twistlock (27) and because the securing part (35) is seated on the tapering of the housing (19) the bolt (29) is guided in the link drive arrangement (23) from the lower position to the middle position so that the locking bar rotates through 90°. This is shown in FIG. 3*b*. Now the twistlock (27) can be led through the upper opening of the casting (4). The securing part (35) is no longer seated on the tapering of the housing (19). The piston (22) is slid with its engagement nose (21) from the upper engagement groove to the middle engagement groove. The threaded rod (17) and with it the piston (22) and the locking bar (24), which by its weight is directed downwards, can now be moved downwards. During that a guide nose (26) at the support bearing (25) being guided by the guiding groove (34) prevents any rotation of the locking bar (24). Sensors (30,31) being arranged in a defined distance at the locking bar indicate to the crane driver the actual position of the locking bar (24) through a signal generator (32) which transfers the signals via a wire (18) to the control unit (11).

Figure 4:
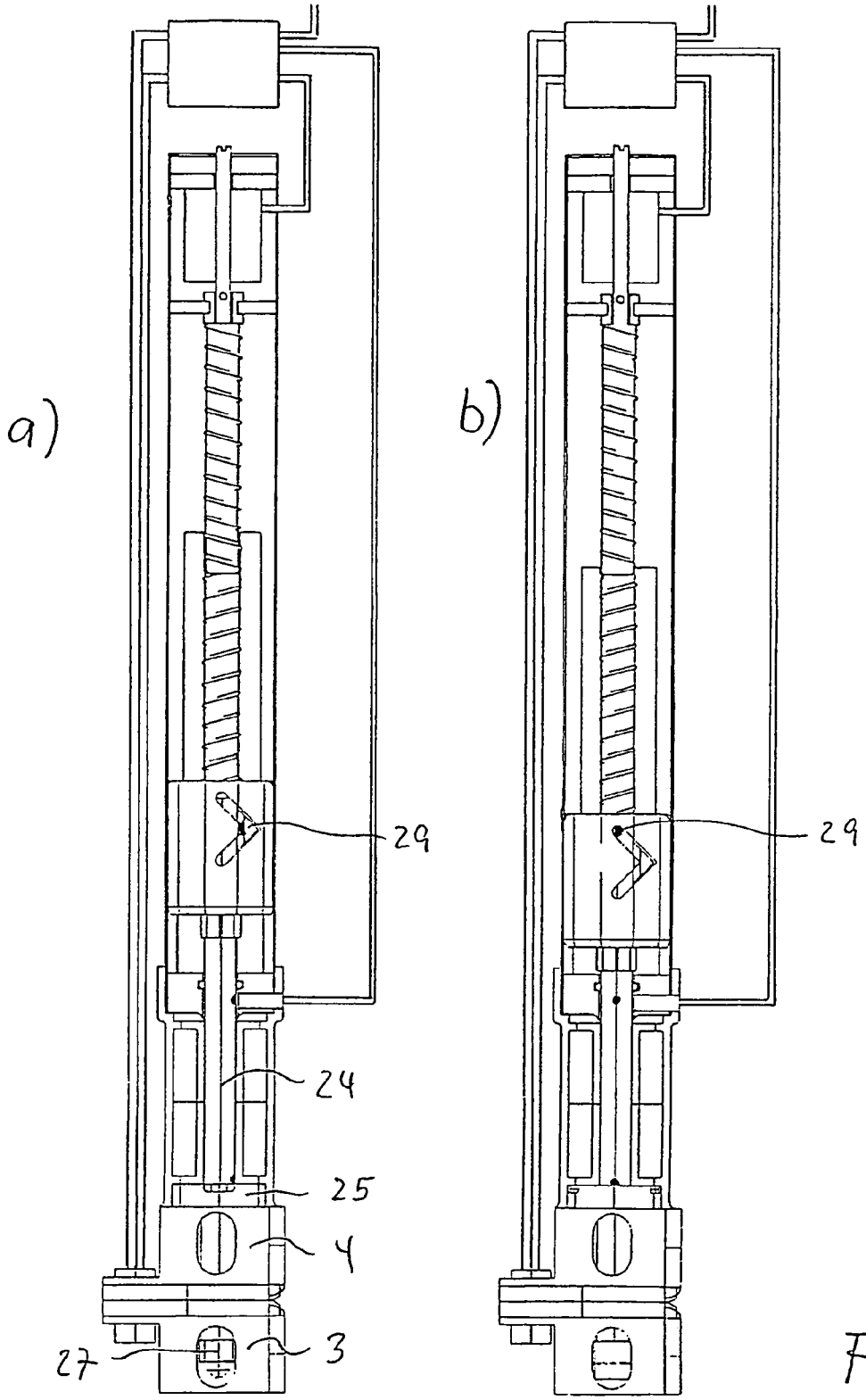

FIGS. 4*a* and *b* show the locking bar in a position in which the twistlock (27) has penetrated the casting (3) of the container beneath. In FIG. 4*a* the locking bar (24) has reached its lowest position. The support bearing (25) is seated on the casting (4).

The bolt (29) is still located in the middle position in the link drive arrangement (23) as the locking bar (24) has been prevented from twisting by the guiding nose (26) led in the guiding groove (34). In the lowest position of the locking bar (24) the guiding nose (26) is no longer led by the guiding groove (34) so that the locking bar is now rotatable again. If now the threaded rod (17) with the piston (22) is further moved downwards the locking bar (24) with the bolt (29) is prevented from that movement so that the bolt (29) is shifted in the link drive arrangement (23) from the middle position to the upper position and thus the locking bar rotates through 90°. The engagement nose (21) has now penetrated the lower engagement groove (28), and the securing part (35) is being shifted beneath the securing part (36) making a lifting of the locking bar (24) impossible. The twistlock (27) has been twisted in the casting (3) so that the locking procedure has been finalized as can be seen in FIG. 4*b*.

If the electric drive (14) has the opposite rotation direction the unlocking procedure will be conducted in the opposite order.

The wires (37,38) supply the next following container with electrical energy and transfer the signals and data from and to the crane driver. In this way as many containers standing beneath each other as desired may be separately or commonly locked or unlocked.

The specification incorporates by reference the disclosure of PCT/DE02/00623 filed Feb. 20, 2002.

The present invention is, of course, in no way restricted to the specific discloser of the specification and drawings, but also encompasses any modifications within the scope of the appended claims.

LIST OF REFERENCE FIGURES

1=Container
2=Corner
3=Upper casting
4=Lower Casting
5=Closure element
5'=Opened corner
6=Upper transverse frame
7=Lower transverse frame
8=Longitudinal side
9=Transverse side
10=Carrier arm of container spreader
11=Control unit
12=Incoming supply
13=Wire
14=Electric drive
15=Housing
16=Threaded rod
17=Threaded rod
18=Wire
19=Housing
20=Cylinder
21=Engagement nose
22=Piston
23=Link drive arrangement
24=Locking bar
25=Support bearing
26=Guide nose
27=Twistlock
28=Engagement groove
29=Bolt
30=Sensor
31=Sensor
32=Signal generator
33=Seals
34=Guiding groove
35=Securing part
36=Securing part
37=wire
38=wire
39=Guide

What is claimed is:

1. A container having corner regions with hollow bodies, comprising:

locking devices adapted to be received in said corner regions;

corners;

electrically driven, rotatable and displaceable locking mechanisms respectively disposed in said corners;

for a lower region of each locking mechanism, a locking member that is adapted to engage in corresponding hollow bodies, disposed in upper corner regions of a comparable container disposed there below and adapted to receive locking devices, for interlocking said containers; and sensors and signal emitters for indicating a respective position of one of said locking mechanisms in a corner of said container.

2. A container according to claim 1, which is furthermore provided with a frame structure, at least one part of which is provided with at least one opening that is adapted to be closed in a water tight and dust tight manner.

3. A container according to claim 2, wherein said locking mechanism is disposed in a housing that is adapted to be removed from a corner in a modular manner.

4. A container according to claim 2, wherein said hollow bodies are detachably connected with adjacent frame parts.

5. A container according to claim 1, which is further provided with means for receiving electrical energy and conveying it on.

6. A container according to claim 1, which further comprises a control unit that not only regulates an application of power to said container but also a control of power to a next container, wherein said control unit receives, procesess and conveys signals from said sensors.

7. A container according to claim 6, wherein said control unit is adapted to store and convey on data relating to said container and its load.

8. A container according to claim 1, which includes an electric drive that is provided with a piston, in a wall of which is disposed an elongated recess that has the approximate appearance of a V that has been rotated by 90°, and wherein a bolt, that is disposed on a locking bar of said locking mechanism, engages in said recess.

9. A container according to claim 8, wherein said piston is provided with an engagement nose at a lower end thereof.

10. A container according to claim 9, wherein said locking bar is provided with engagement grooves in which said engagement nose of said piston is adapted to engage.

11. A container according to claim 1, wherein means for receiving and conveying on power, electronic information and other resources that may be required are provided in the region of said hollow bodies for receiving said locking devices.

* * * * *